US010301132B2

(12) United States Patent
Gonzalez Perello et al.

(10) Patent No.: US 10,301,132 B2
(45) Date of Patent: May 28, 2019

(54) MEDIA ROLL HOLDER

(71) Applicant: HEWLETT-PACKARD DEVELOPMENT COMPANY, L.P., Houston, TX (US)

(72) Inventors: Daniel Gonzalez Perello, Terrassa (ES); Joaquim Brugue Garvi, Barcelona (ES); Felix Ruiz Martinez, Sant Cugat del Valles (ES); Xavier Alonso Becerro, San Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 220 days.

(21) Appl. No.: 15/314,894

(22) PCT Filed: Jun. 5, 2014

(86) PCT No.: PCT/US2014/041135
§ 371 (c)(1),
(2) Date: Nov. 29, 2016

(87) PCT Pub. No.: WO2015/187167
PCT Pub. Date: Dec. 10, 2015

(65) Prior Publication Data

US 2017/0144853 A1 May 25, 2017

(51) Int. Cl.
*B65H 16/06* (2006.01)
*B41J 2/155* (2006.01)
(Continued)

(52) U.S. Cl.
CPC ..... *B65H 16/06* (2013.01); *B41J 2/155* (2013.01); *B41J 11/04* (2013.01); *B65H 23/02* (2013.01); *B65H 2301/41369* (2013.01); *B65H 2301/415085* (2013.01); *B65H 2402/32* (2013.01); *B65H 2403/411* (2013.01); *B65H 2511/12* (2013.01); *B65H 2511/18* (2013.01); *B65H 2601/26* (2013.01); *B65H 2801/15* (2013.01)

(58) Field of Classification Search
CPC ..... B65H 16/06; B65H 23/02; B65H 2301/41369; B65H 2402/32; B41J 11/04
See application file for complete search history.

(56) References Cited

U.S. PATENT DOCUMENTS 4,265,411 A * 5/1981 Fasolak ..... B65H 16/06 242/559.4
4,821,974 A 4/1989 Pidahlein
(Continued)

FOREIGN PATENT DOCUMENTS

CN 103568600 2/2014
CN 103660628 3/2014
(Continued)

*Primary Examiner* — Sang K Kim
(74) *Attorney, Agent, or Firm* — HP Inc. Patent Department

(57) ABSTRACT

In one example, a holder for a media roll includes a first support to support a first end of the roll, a second support to support a second end of the roll, and a shifter to change the distance between the first support and the first end of the roll without changing the distance between the second support and the second end of the roll.

18 Claims, 18 Drawing Sheets

(51) Int. Cl.
*B41J 11/04* (2006.01)
*B65H 23/02* (2006.01)

(56) References Cited

U.S. PATENT DOCUMENTS

| | | | | |
|---|---|---|---|---|
| 6,431,492 | B1 * | 8/2002 | Chillscyzn | B41J 15/042 242/577 |
| 7,967,515 | B2 | 6/2011 | Puigardeu et al. | |
| 2002/0175985 | A1 * | 11/2002 | Zevin | B41J 15/02 347/104 |
| 2004/0200922 | A1 | 10/2004 | Nakamura et al. | |
| 2006/0188312 | A1 | 8/2006 | Ward | |
| 2007/0296792 | A1 | 12/2007 | Yun et al. | |
| 2008/0277851 | A1 | 11/2008 | Genta | |
| 2009/0072073 | A1 | 3/2009 | Campbell et al. | |
| 2010/0061790 | A1 * | 3/2010 | Yu | B41J 3/4075 400/613 |
| 2013/0126664 | A1 | 5/2013 | Hitz | |
| 2013/0278696 | A1 | 10/2013 | Akatsu et al. | |
| 2015/0103126 | A1 * | 4/2015 | Akatsu | B65H 16/06 347/104 |

FOREIGN PATENT DOCUMENTS

| | | |
|---|---|---|
| DE | 2261559 | 6/1974 |
| DE | 3203646 | 8/1983 |
| EP | 0086888 | 8/1983 |
| EP | 1849616 | 6/2010 |
| GB | 317881 | 8/1929 |
| JP | 2007261086 | 10/2007 |
| WO | WO-2013/153747 | 10/2013 |
| WO | WO-2013153747 | 10/2013 |

* cited by examiner

MEDIA ROLL HOLDER

BACKGROUND

In some inkjet printers, a media wide printhead assembly that remains stationary during printing, commonly called a print bar, is used to print on paper or other print media moving past the print bar.

DRAWINGS

FIG. 2 is viewed along the line 2-2 in FIG. 1.

The same part numbers designate the same or similar parts throughout the figures.

DESCRIPTION

Print bars are susceptible to print quality defects caused by the uneven use of the fluid dispensing elements in the print bar. For example, when printing documents with a long recurring image (e.g., engineering drawings with a standard border), some of the fluid dispensing elements are used for the full length of every page while other elements are used much less often. For another example, printing on wider media after extended printing on narrower media re-activates elements that have been inactive for long periods. Over time, the uneven use of the fluid dispensing elements can cause visible print quality defects and lead to the premature failure of over-used elements.

A new holder has been developed for roll type print media to vary the position of the media for more even use of the fluid dispensing elements. In one example, the holder includes a first support to support a first end of the roll, a second support to support a second end of the roll, and a shifter to change the distance between the first support and the first end of the roll without also changing the distance between the second support and the second end of the roll, allowing a shift in the position of the media roll with respect to the print bar. In one implementation for the shifter, the hub assembly at the first support includes an adjustable spacer operatively connected to the hub and an actuator to adjust the position of the spacer to vary the distance between the hub and the first support, thus shifting the position of the media roll. Shifting the position of the media roll periodically helps reduce the risk of defects caused by the uneven use of fluid dispensing elements in the print bar.

While examples are described with reference to a print media roll in a printer, examples are not limited to printers or rolls of print media but may be implemented in other devices for other types of media rolls.

As used in this document, a "printhead" means that part of an inkjet printer or other inkjet type dispenser for dispensing fluid from one or more openings, for example as drops or streams; and a "print bar" means a structure or device holding an arrangement of one or more printheads that remains stationary during printing. "Printhead" and "print bar" are not limited to printing with ink but also include inkjet type dispensing of other fluids and/or for uses other than printing.

Figure 1:
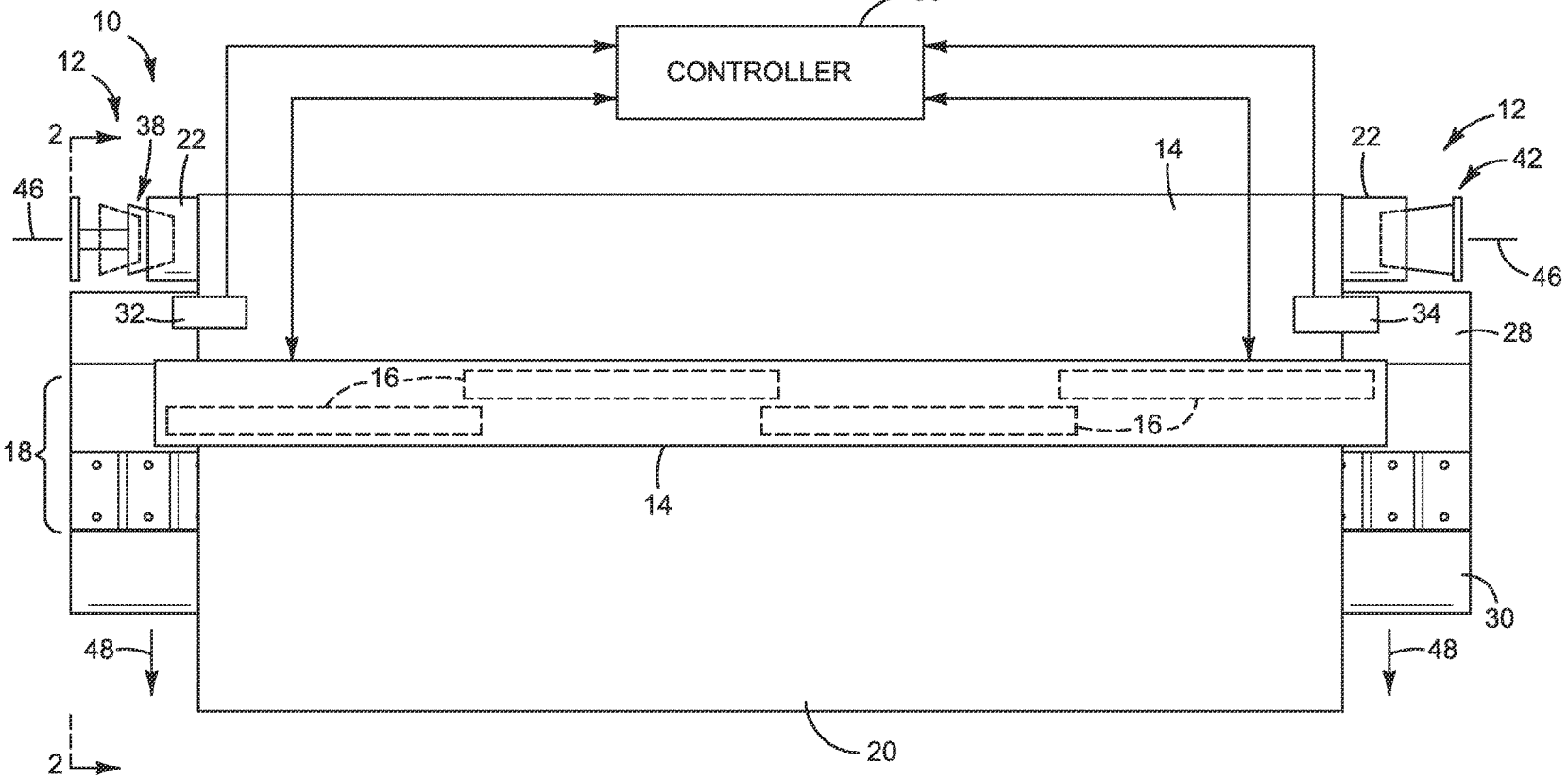
FIGS. 1 and 2 are plan and side elevation views, respectively, illustrating an inkjet printer implementing one example of an adjustable holder for a roll of print media.
Figure 2:
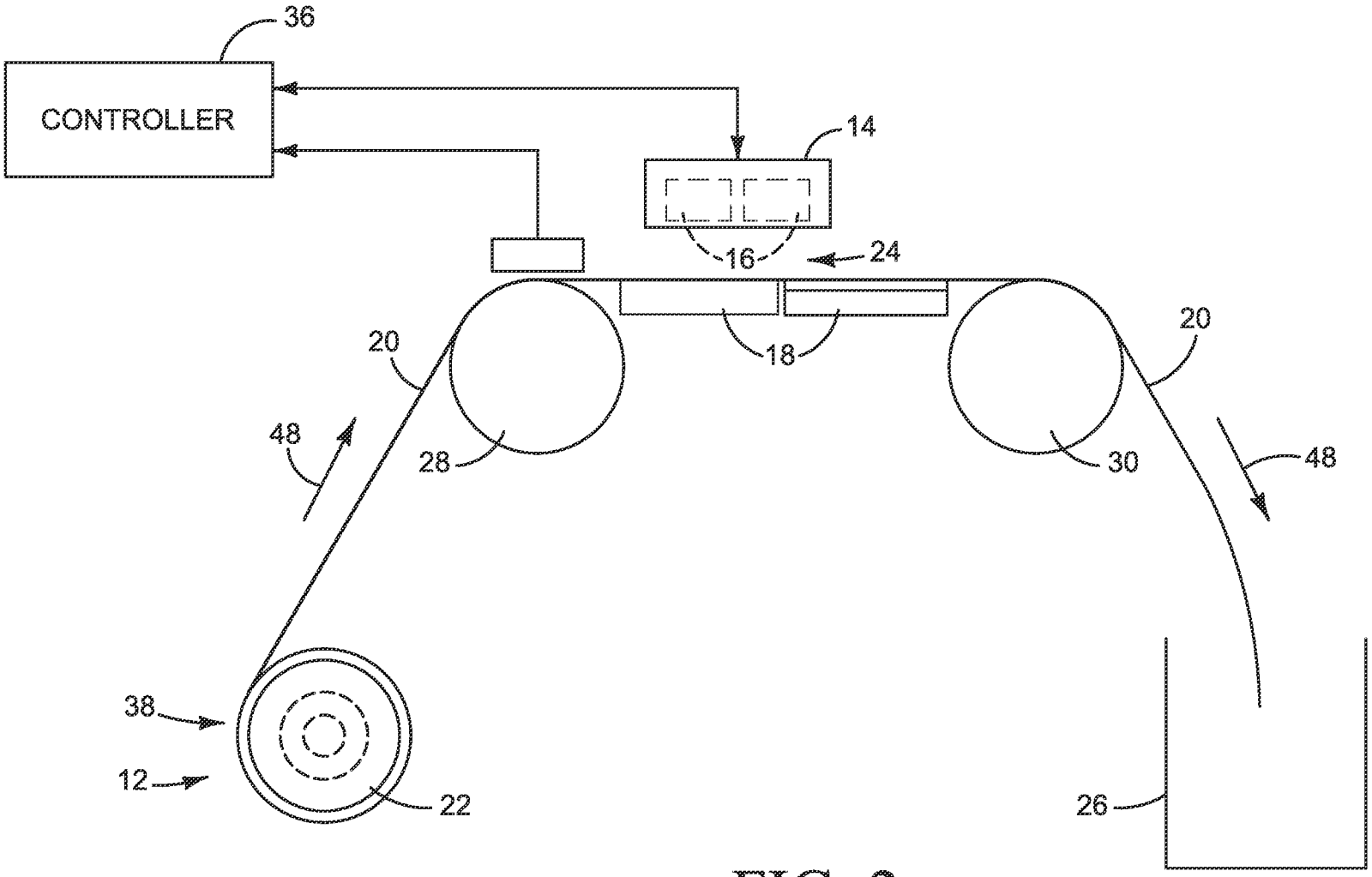

FIGS. 1 and 2 illustrate an inkjet printer 10 implementing one example of an adjustable holder 12 for a roll of print media. Referring to FIGS. 1 and 2, printer 10 includes a print bar 14 with multiple printheads 16 mounted over a platen 18. During printing, a print media web 20 from a supply roll 22 supported on holder 12 is moved across platen 18 into a print zone 24 under print bar 14. After printing, for example, printed sheets may be cut from web 20 and collected in a bin 26. Intermediate rollers 28, 30 may be used to help transport web 20 through print zone 24 and to help control the direction and tension of web 20 over platen 18.

Printer 10 also includes edge detectors 32, 34 connected to a controller 36. Controller 36 represents generally the electronic instructions, processors and associated memories, and the electronic circuitry and components needed to control the operative elements of a printer 10, including print bar 24. For example, controller 36 may adjust printhead control data to print the desired image based on the actual position of web 20 signaled by detectors 32, 34. Accordingly, when media web 20 is shifted laterally with respect to print bar 14 (and thus printheads 16) by adjusting the position of roll 22 on holder 12, detectors 32, 34 signal the new position of web 20 so that controller 36 can adjust the printhead control data to account for the shift, including using more or fewer or different dispensing elements in printheads 16.

Figure 3:
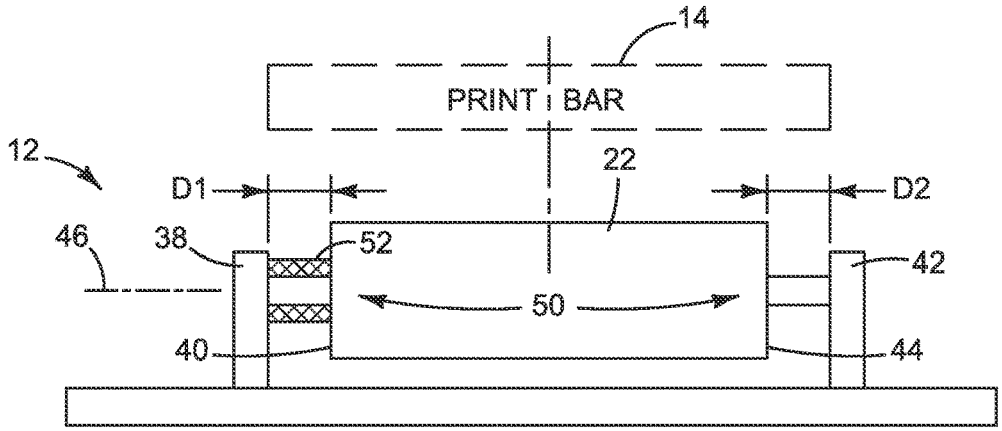
FIGS. 3-5 illustrate examples for shifting a roll of print media with respect to a print bar using an adjustable holder.
Figure 4:
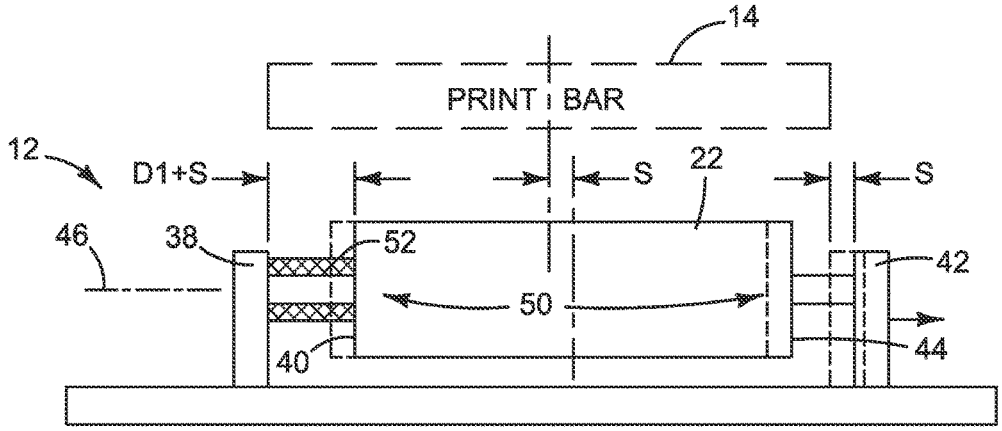
Figure 5:
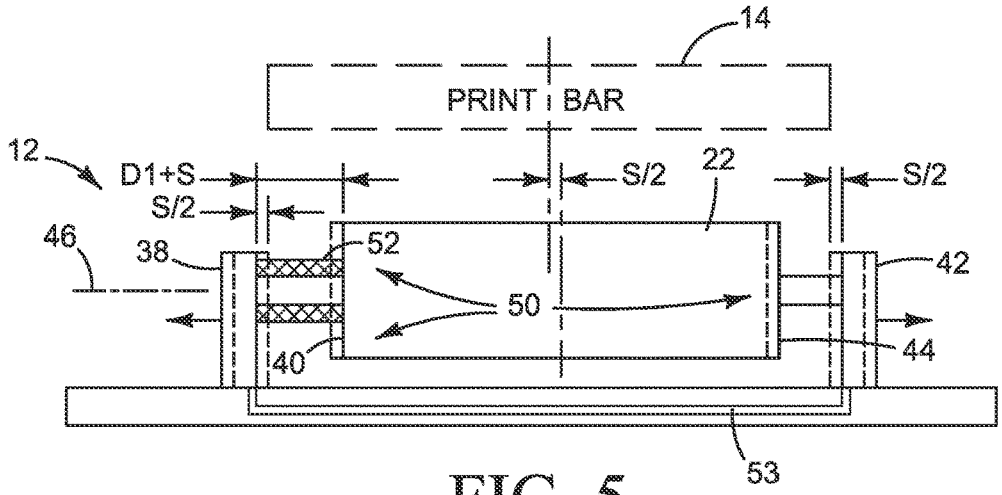

FIGS. 3-5 illustrate examples for shifting a print media roll 22 (and thus web 20 in FIGS. 1 and 2) with respect to a print bar 14 using an adjustable holder 12. Referring first to FIG. 3, holder 12 includes a first support 38 to support one end 40 of roll 22 and a second support 42 to support the other end 44 of roll 22. Supports 38 and 42 support roll 22 along an axis 46 that extends laterally across print bar 14 orthogonal to the direction media web 20 moves through print zone 24. The media direction is indicated by arrows 48 in FIGS. 1 and 2.

Holder 12 also includes a shifter 50 to shift roll 22 along axis 46. In the example shown in FIGS. 3-5, shifter 50 is implemented as an adjustable length spacer 52 and a movable second support 42 (FIG. 4) or movable first and second supports 38, 42 (FIG. 5). FIG. 3 shows the position of roll 22 with a shorter spacer 52 in which the distance between first support 38 and roll end 40 is D1. In FIG. 4, a longer spacer 52 increases the distance between first support 38 and roll end 40 to D1+S. The distance D2 between second support 42 and roll end 44 does not change and second support 42 moves (or is moved) the distance S so that roll 22 shifts the same distance S with respect to print bar 14. Thus, in the example of FIG. 4, shifter 50 includes a single adjustable length spacer 52 or multiple different length spacers 52 and a movable second support 42. In one example process for shifting web roll 22 from the position shown in FIG. 3 to the position shown in FIG. 4, a user unloads roll 22, installs a longer spacer 52 or adjusts the length of a variable length spacer 52, moves second support 42 out the added length S of spacer 52, and reloads the web roll 22.

In the example shown in FIG. 5, each support 38, 42 moves (or is moved) a distance S/2 in response to a longer spacer 52 so that roll 22 shifts a distance S/2. The example of FIG. 5 may be implemented in printers that use two slide-able supports 38, 42 linked together to keep the centerline between supports, and thus the centerline of web roll 22, at the same location when loading different size media rolls into holder 12. A link 53 between supports 38, 42 is implemented in some printers, for example, with a rack gear fastened to each support 38, 42 and a pinion gear connecting the two racks. Alternatively, the example of FIG. 5 may be implemented manually, for example by adjusting the length of spacer 52 when holder 12 is empty (a web roll 22 not loaded), adjusting the position of each support 38, 42 manually, and then loading a roll 22 into holder 12.

Figure 6:
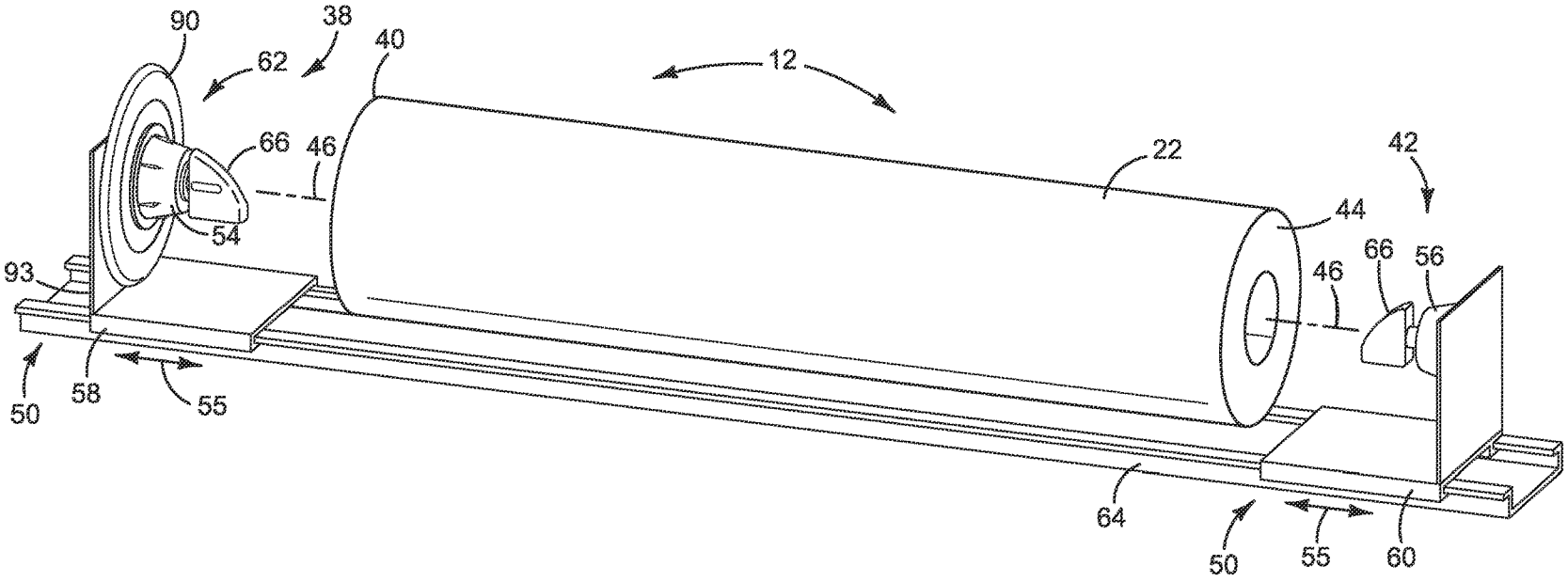
FIGS. 6 and 7 Illustrate one example of an adjustable media roll holder such as might be used in the printer shown in FIGS. 1 and 2.
Figure 7:
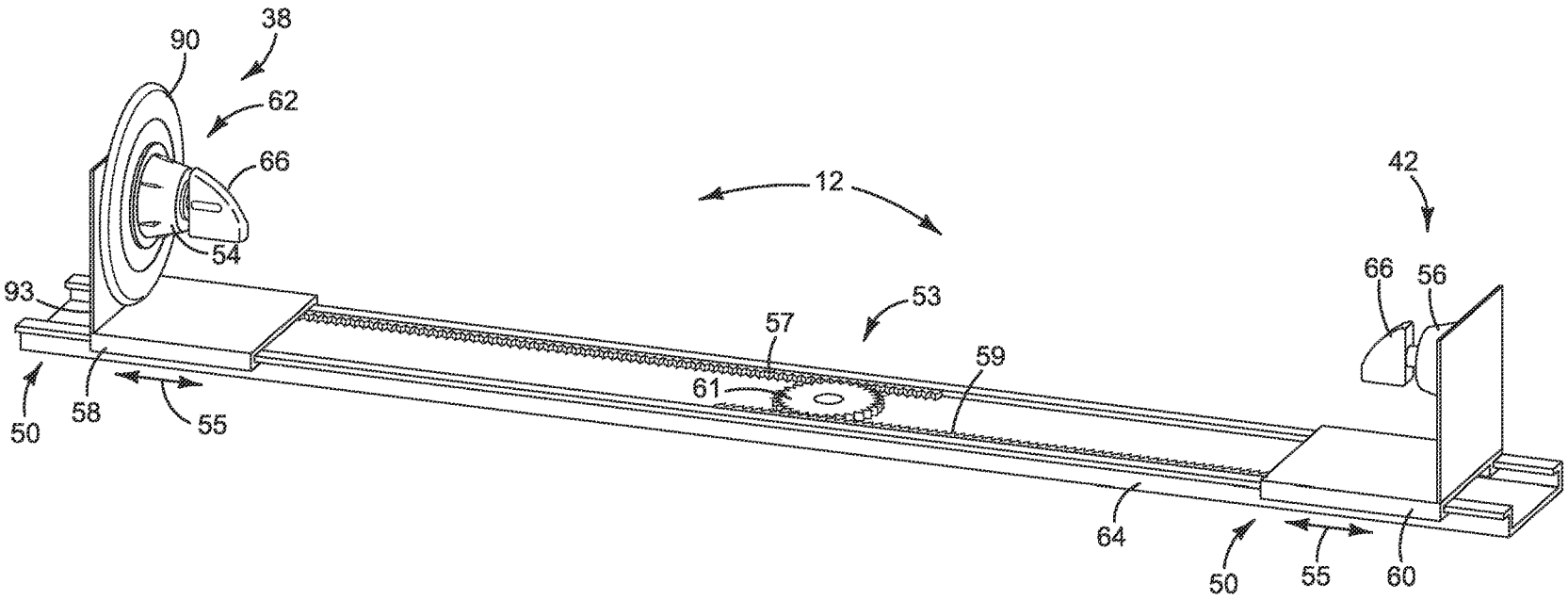

FIGS. 6 and 7 Illustrate one example of an adjustable media roll holder 12 such as might be used in printer 10 shown in FIGS. 1 and 2. Referring first to FIGS. 6 and 7, holder 12 includes a first support 38 to support one end 40 of roll 22 and a second support 42 to support the other end 44 of roll 22. Supports 38 and 42 support roll 22 along an axis 46 that extends along the width of media roll 22 orthogonal to the direction media web 20 moves through print zone 24 in printer 10 in FIGS. 1 and 2. Supports 38, 42 are shown moved away from roll 22 in FIG. 6 to more clearly show parts of each support. Roll 22 is omitted from FIG. 7 to show link 53.

Each support 38, 42 includes a hub 54, 56 mounted to a car 58, 60. Each hub 54, 56 is mounted on an axle with a bushing or other suitable structure that allows each hub 54, 56 (and thus roll 22) to rotate around axis 46. Also, hub 54 is part of a hub assembly 62 that includes an adjustable spacer (not shown in FIGS. 6 and 7) described below with reference to FIGS. 8-18. Each car 58, 60 slides along axis 46 on a track 64 to vary the distance between the hubs, for example to accommodate different width rolls 22 and to shift the position of a roll 22, as indicated by arrows 55. As shown in FIG. 7, a link 53 links cars 58, 60 such that moving one car automatically moves the other car. In the example shown, link 53 includes racks 57, 59 fastened to cars 58, 60, respectively, and a pinion 61 connecting the two racks 57, 59. While a rack and pinion is shown, any suitable link 53 may be used. Also, while it is expected that a link 53 usually will be configured so that both cars move equal distances, other drive ratios are possible.

A wedge shaped guide 66 helps guide each end 40, 44 of roll 22 on to hubs 54, 56. Holder 12 also includes a shifter 50 to shift roll 22 along axis 46. Shifter 50 includes an adjustable spacer in hub assembly 62 that moves hub 54 linearly along axis 46 with respect to car 58, and supports 38 and 42 that are movable along axis 46. Hub 56 in the movable second support 42 is stationary linearly along axis 46 with respect to car 60.

Figure 8:
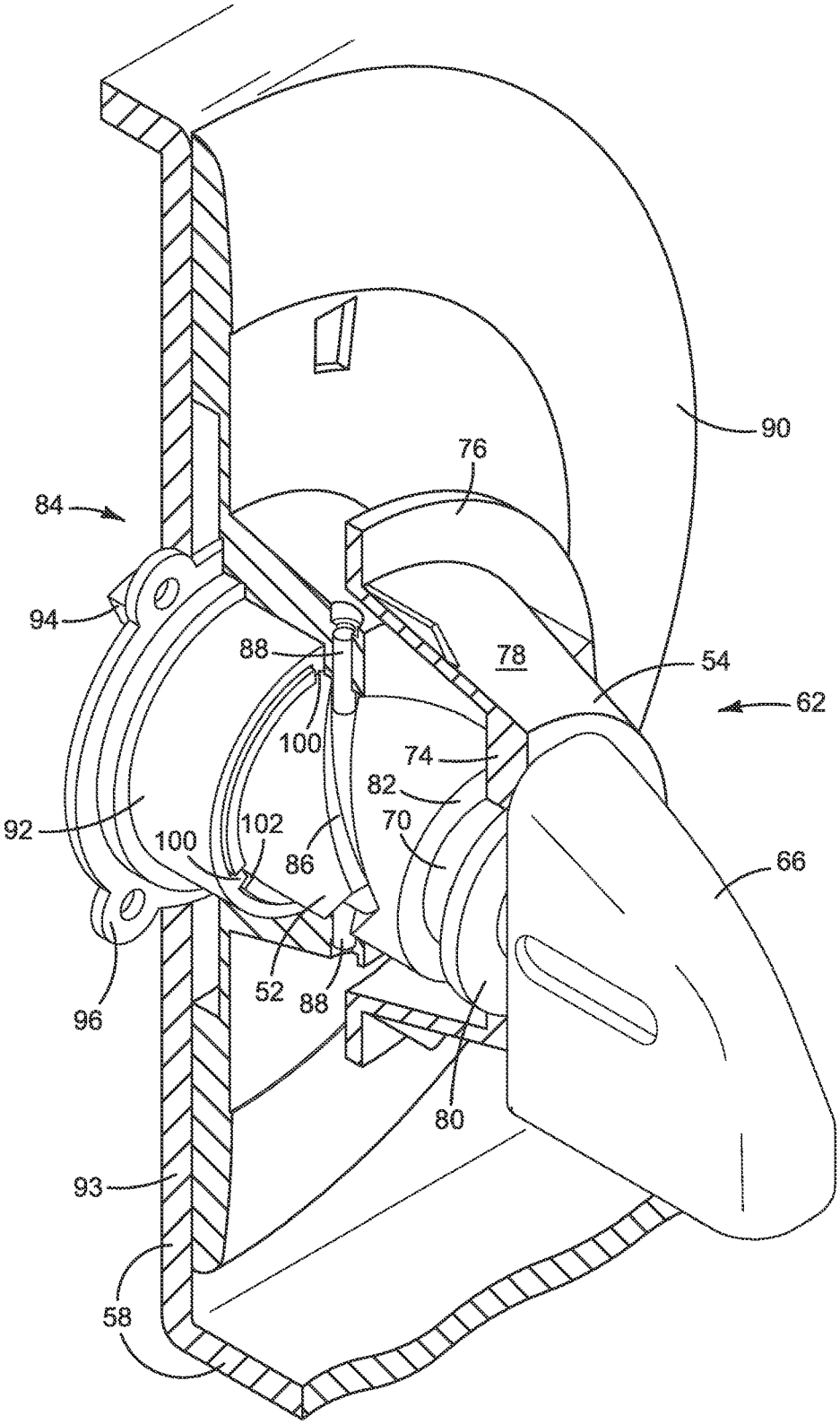
FIGS. 8 and 9 are detail cut-away perspective and section views, respectively, of one example of a hub assembly with an adjustable spacer in the roll holder shown in FIGS. 6 and 7.
Figure 9:
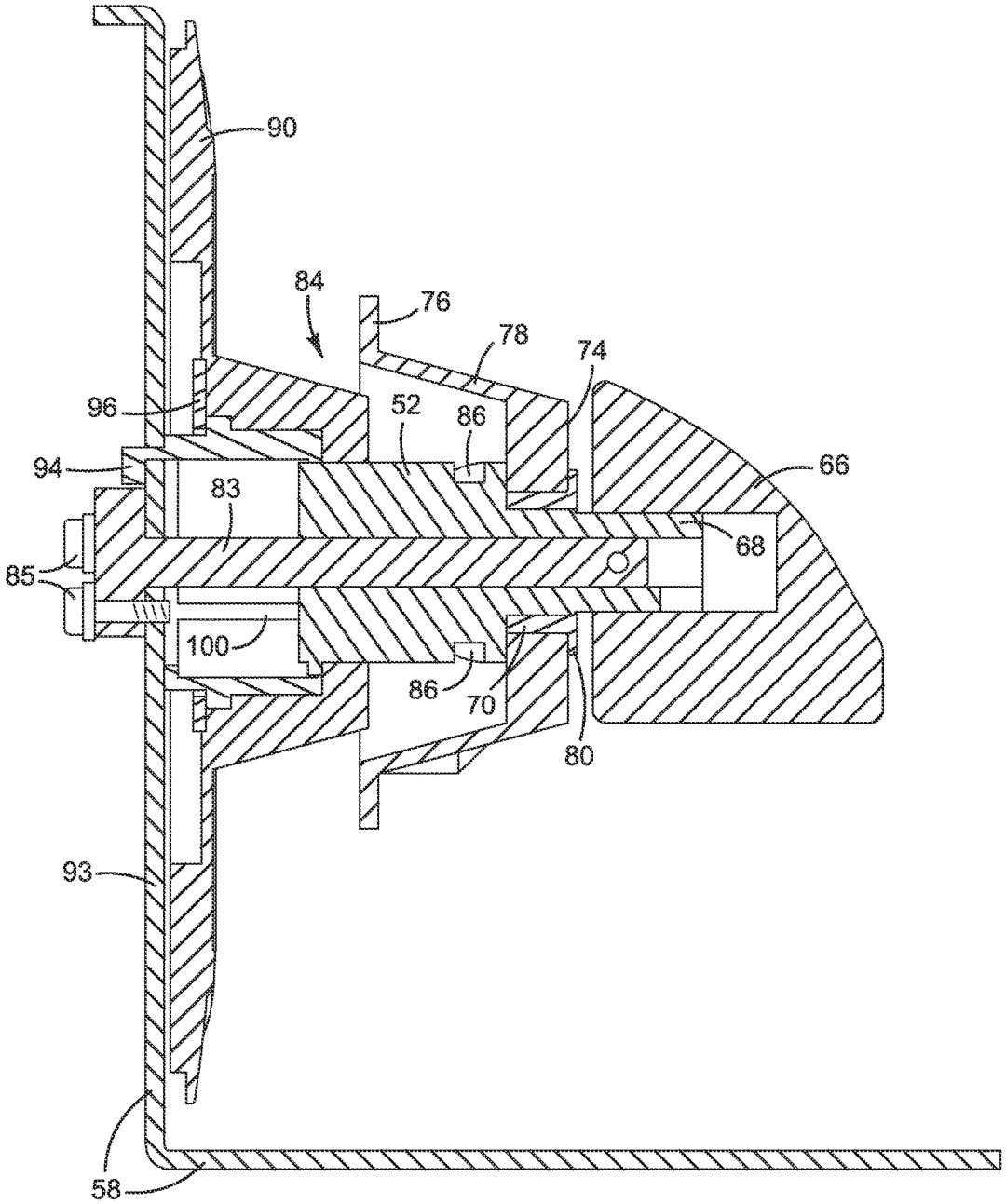
Figure 10:
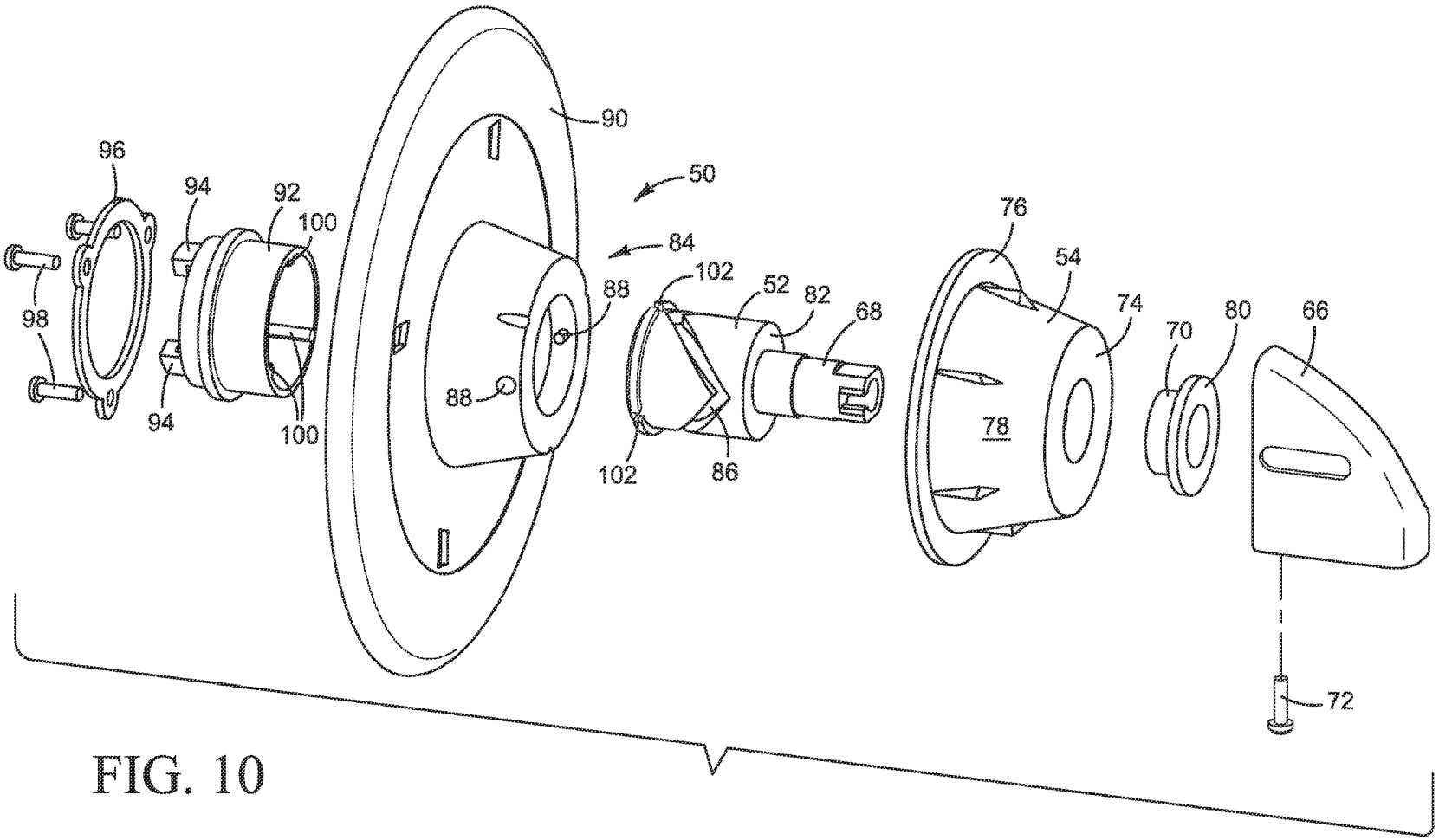
FIG. 10 is an exploded view of the hub assembly shown in FIGS. 8 and 9.

The structure and operation of one example of a shifter 50 with adjustable spacer 52 will now be described in detail with reference to FIGS. 8-18. FIGS. 8 and 9 are cut-away perspective and section views, respectively, of hub assembly 62 with adjustable spacer 52 and hub 54. FIG. 10 is an exploded view of hub assembly 62. FIGS. 11-14 and 15-18 are a sequence of views showing a shifting operation with adjustable spacer 52.

Referring first to FIGS. 8-10, hub 54 is mounted to an axle 68 in hub assembly 62 with a bushing 70 pressed on to axle 68, or with another suitable mechanism that allows hub 54 to rotate on axle 68. Wedge guide 66 is mounted over the end of axle 68 and fastened in place, for example with a set screw 72 (FIG. 10). Huh 54 includes forward flange 74, a rearward flange 76 and a sloping surface 78 extending between flanges 74, 76. One end of the media roll is supported on hub surface 78 when a media roll is loaded in the holder. The forward flange 74 of hub 54 is sandwiched between a flange 80 on bushing 70 and a forward part 82 of spacer 52, as best seen in FIGS. 8 and 9. In the example shown, spacer 52 and axle 68 are integrated into a single part in which the forward part 82 of the larger diameter spacer 54 forms a step down to the smaller diameter axle 68. The integrated spacer/axle part is supported on a shaft 83 (FIG. 9) attached to the upright back plate 93 of car 58 with, for example, screws 85. Shaft 83 is omitted from FIG. 10 to more clearly show other parts of hub assembly 62.

Huh assembly 62 includes an actuator 84 to move spacer 52 forward and rearward to push out hub 54 and pull in hub 54, respectively. In the example shown, actuator 84 includes a helical groove 86 along the outer circumference of spacer 52, pins 88 that ride in groove 86, and a wheel 90 to drive pins 88. Adjusting wheel 90 rotates on a cylindrical axle 92 that is fastened to car back plate 93 with, for example, hooks 94. Wheel 90 is retained in position on axle 92, for example, with a retainer 96 and fasteners 98. Pins 88 and groove 86 act like a lead screw to convert the rotary motion of wheel 90 to linear motion of spacer 52 along axis 46. Other types of cams, cranks, and screws, for example, may be suitable rotary-to-linear motion converters for actuator 84.

Wheel axle 92 also fastens spacer 52, hub 54 and hub axle 68 to car back 93 and prevents spacer 52 and axle 68 from rotating. Keys 100 on the inner circumference of cylindrical wheel axle 92 fit into keyways 102 on spacer 52 (which is integral to axle 68) to prevent spacer 52 and axle 68 from rotating. Actuator pins 88 in groove 86 in spacer 52 determine the axial position of spacer 52 and axle 68, and thus hub 54, with respect to back plate 93. Hooks 94 fasten the entire hub assembly 54 to car 58 through plate 93, thus varying the axial distance between hub 54 and the back 83 of car 58.

Figure 11:
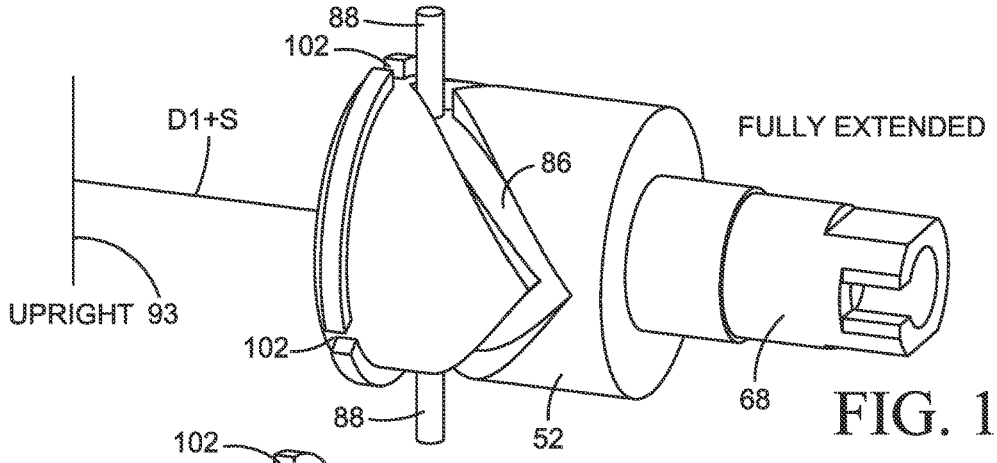
FIGS. 11-14 and 15-18 are a sequence of views showing one example of a shifting operation using the hub assembly shown in FIGS. 8-10.
Figure 12:
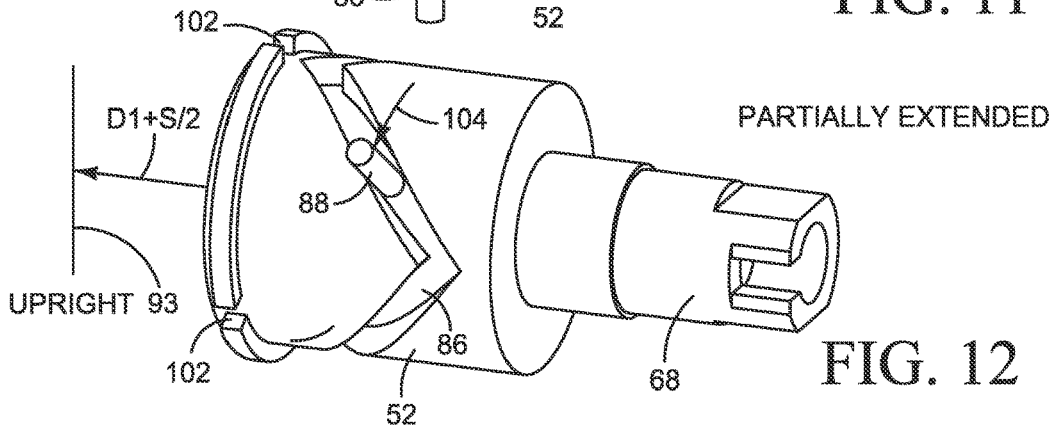
Figure 13:
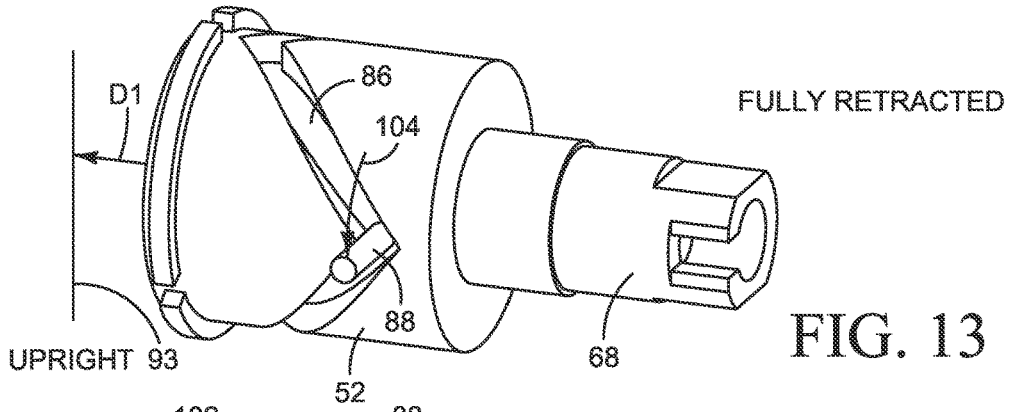
Figure 14:
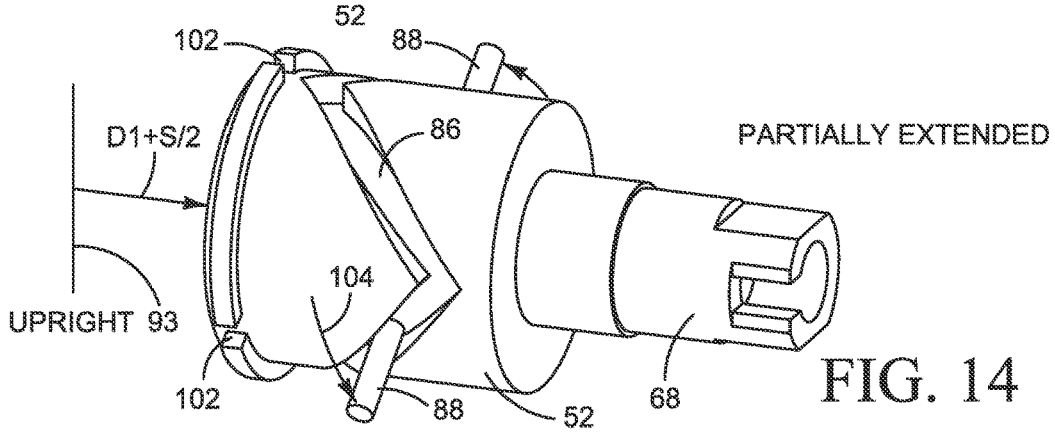
Figure 15:
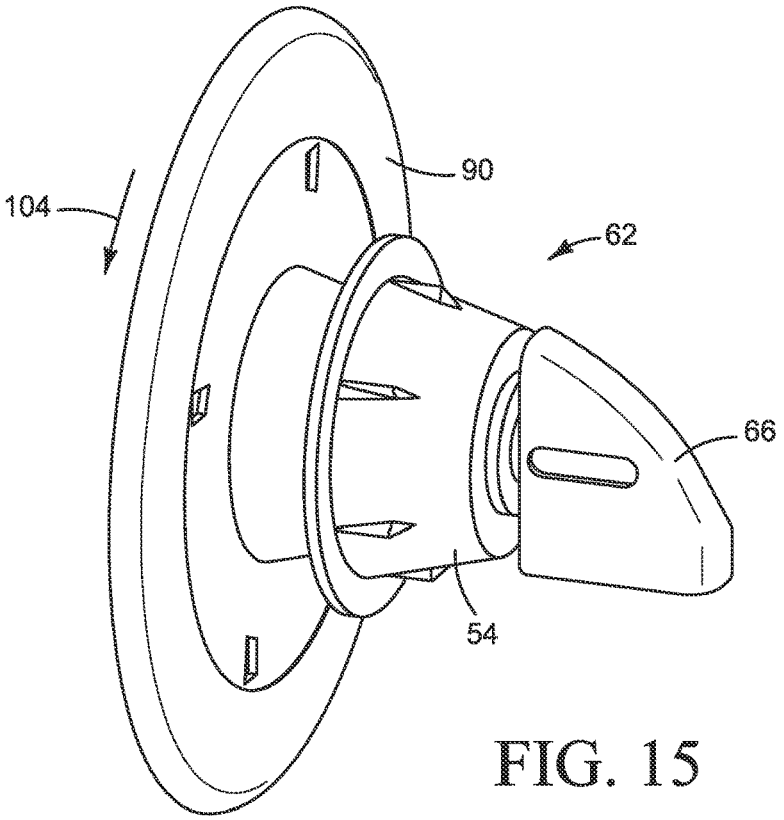
Figure 16:
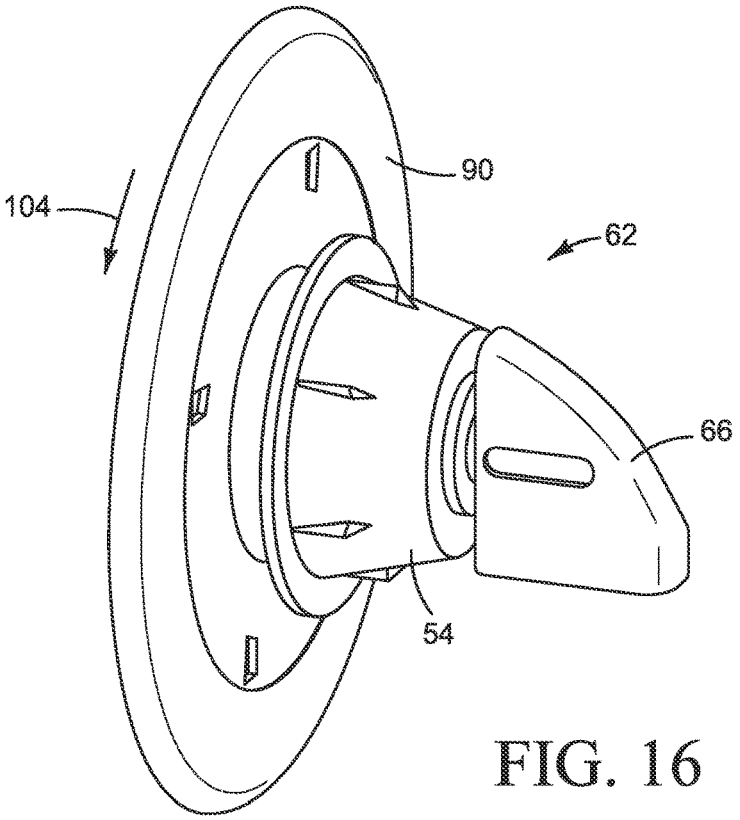
Figure 17:
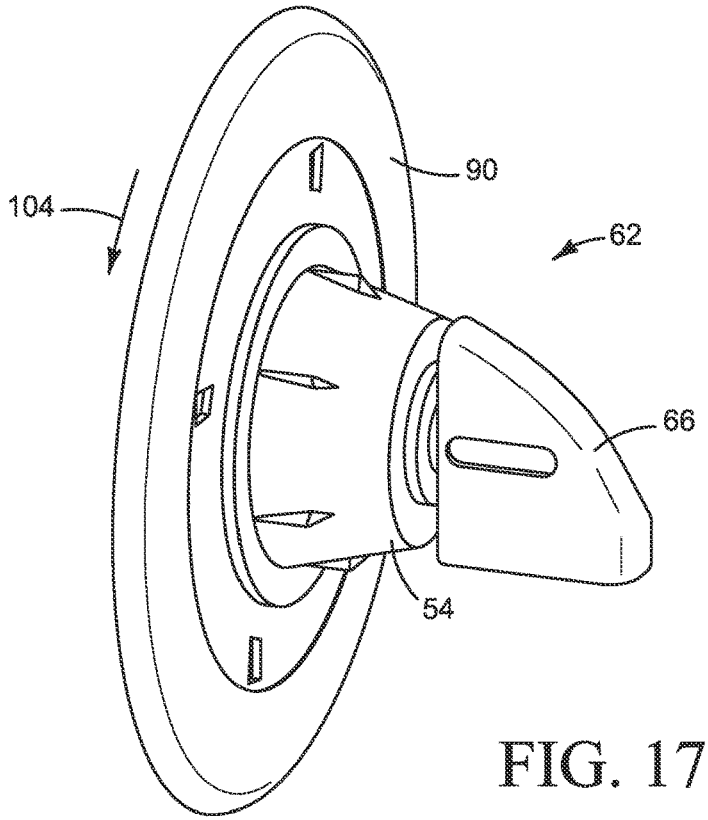
Figure 18:
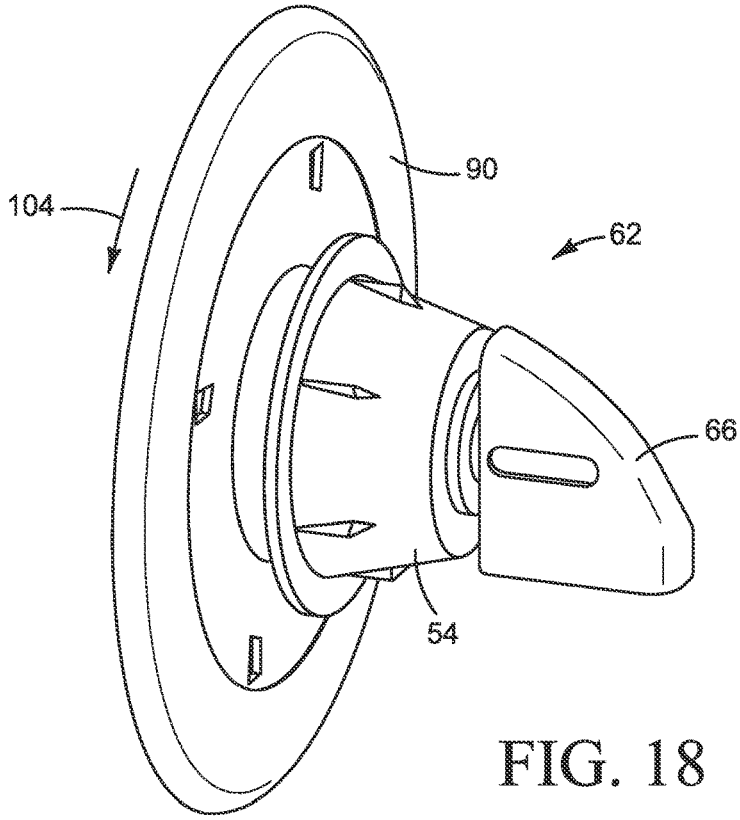

The sequence of views in FIGS. 11-14 and 15-18 illustrate adjusting the position of hub 54 with spacer 52 and actuator 84. The position of spacer 52 in FIGS. 11-14 corresponds to the position of hub 54 in FIG. 15-18, respectively. In FIGS. 11 and 15, spacer 52 and hub 54 are in the fully extended position, for example corresponding to D1+S in FIGS. 4 and 5. Rotating wheel 90 and thus pins 88 counter-clockwise, as indicated by arrows 104 in FIGS. 12 and 16, pulls spacer 52 and hub 54 rearward toward plate 93 to a partially extended position, for example to D1+S/2. Continuing to rotate wheel 90 and thus pins 88 counter-clockwise through 90° of rotation pulls spacer 52 and hub 54 further rearward to the fully retracted position shown in FIGS. 13 and 17, for example corresponding to D1 in FIG. 3. Continuing to rotate wheel 90 and thus pins 88 counter-clockwise past 90° of rotation pushes spacer 52 and hub 54 out, away from plate 93, to a partially extended position shown in FIGS. 14 and 18 (which is the same as FIGS. 12 and 16). Continued rotation of wheel 90 causes spacer 52 and hub 54 to move in and out through a full range of motion back and forth between fully extended and fully retracted positions.

In the example shown, groove 86 extends continuously around the full circumference of spacer 52 alternately angled forward and rearward for each 90° of rotation for reciprocal linear motion so that spacer 52 and hub 54 may be adjusted in and out while rotating wheel 90 in just one direction. This configuration for groove 86 may be desirable, for example, when a ratcheting mechanism is employed to turn wheel 90 as described below with reference to FIGS. 19-25.

For a shifter 50 operated directly by a user, the user must remember or be prompted to periodically operate shifter 50 to promote printhead health by distributing use evenly across of all fluid dispensing elements. The challenge of getting the user to regularly operate shifter 50 is made more challenging by the fact that shifting the media roll is not obviously related to printhead health. To help meet this challenge, the operation of shifter 50 may be linked to loading and unloading a media roll. For example, shifter 50 may be linked to a brake that keeps the car parked during printing but releases the car to move for loading and unloading a media roll.

Figure 19:
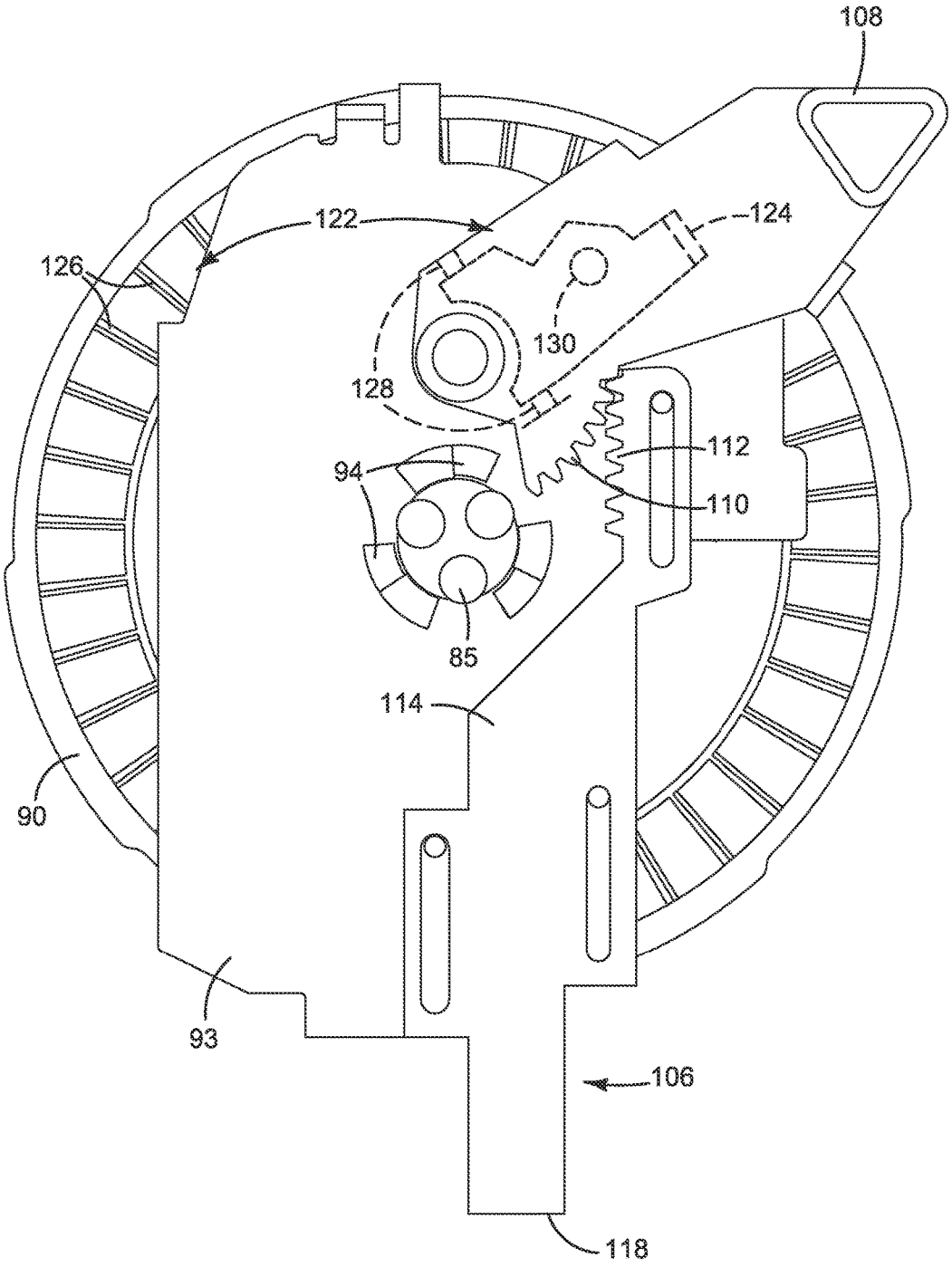
FIGS. 19-25 illustrate one example of a shifter that automatically shifts the position of the media roll holder when loading and unloading a media roll.
Figure 20:
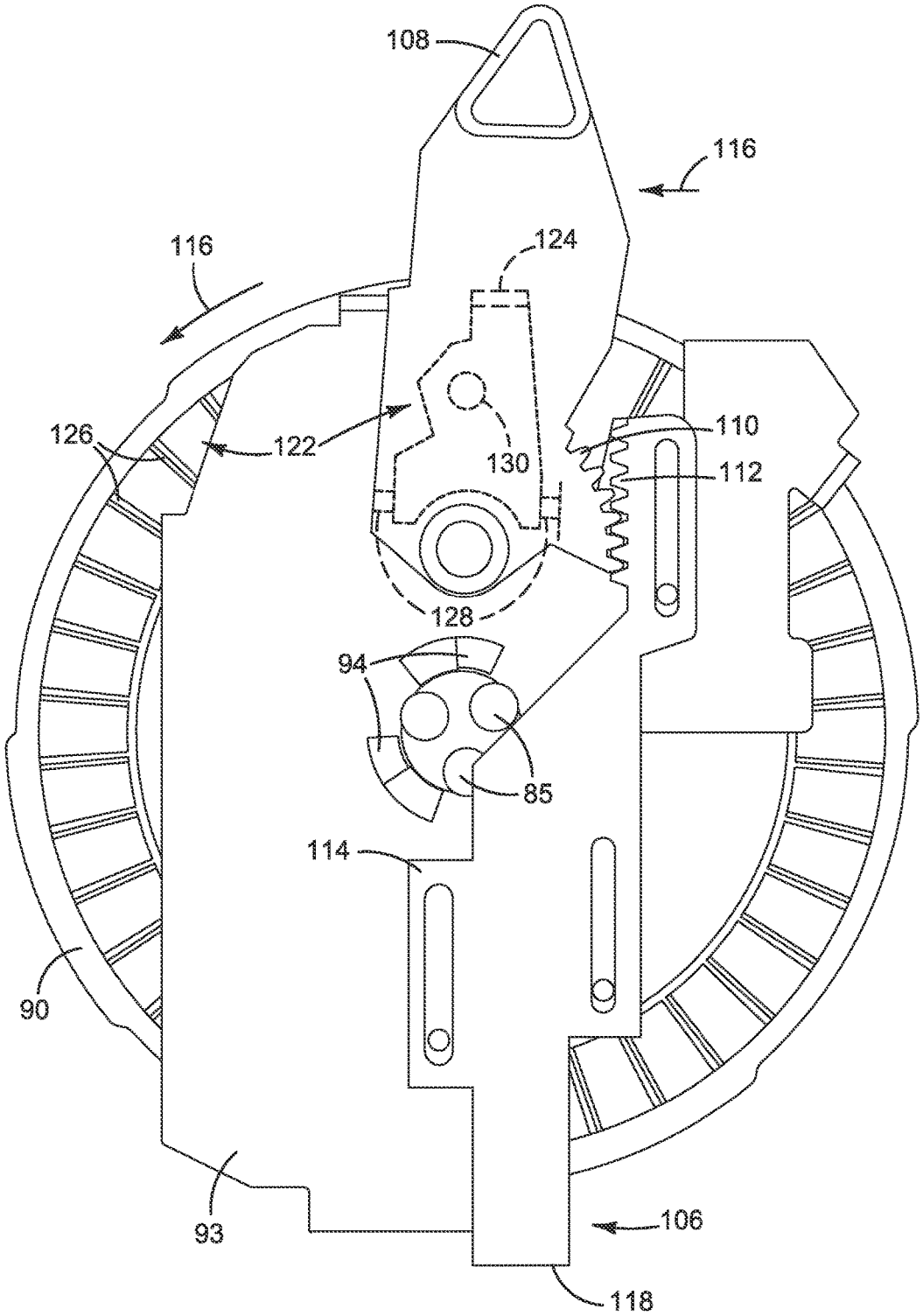
Figure 21:
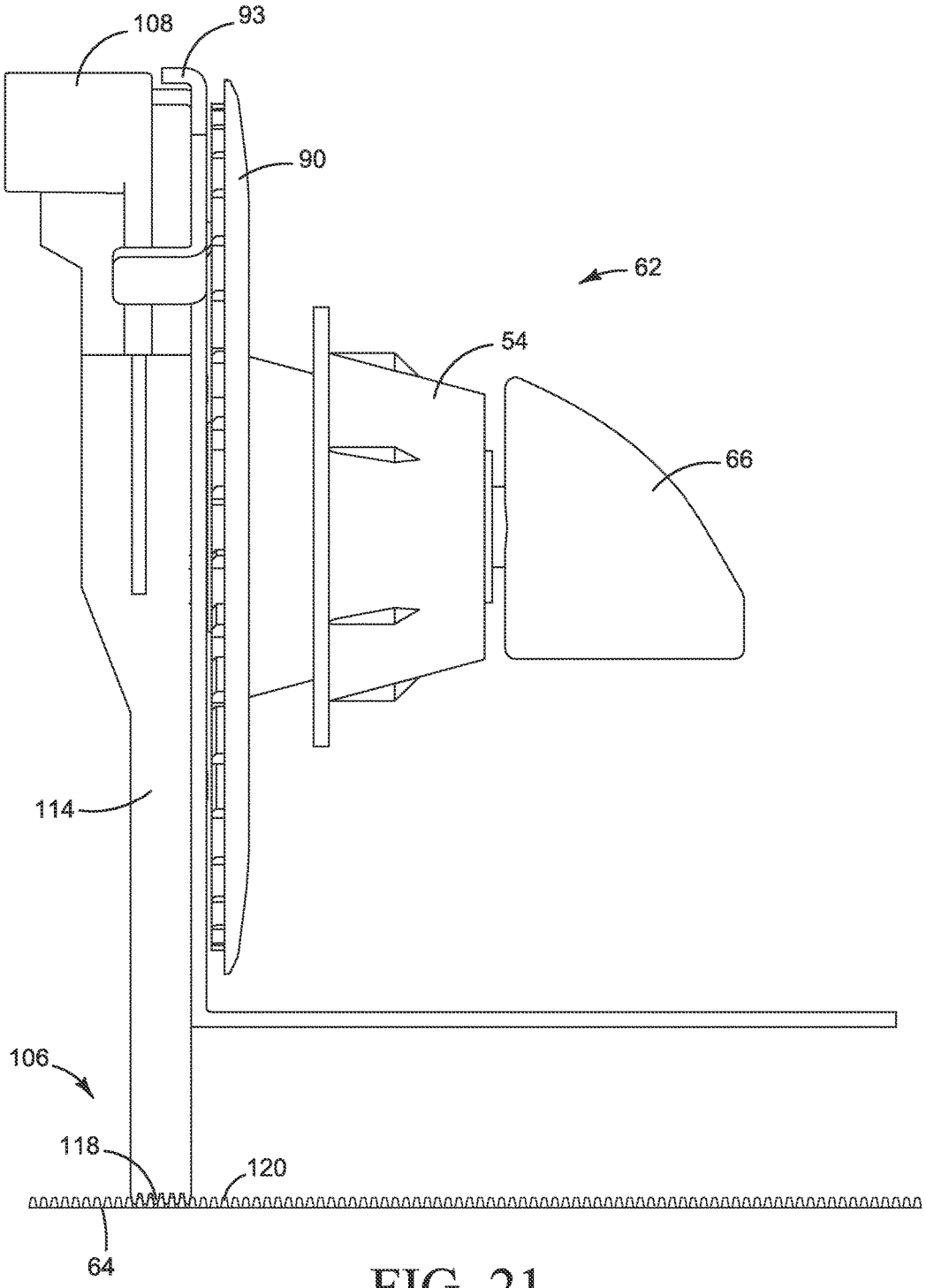
Figure 22:
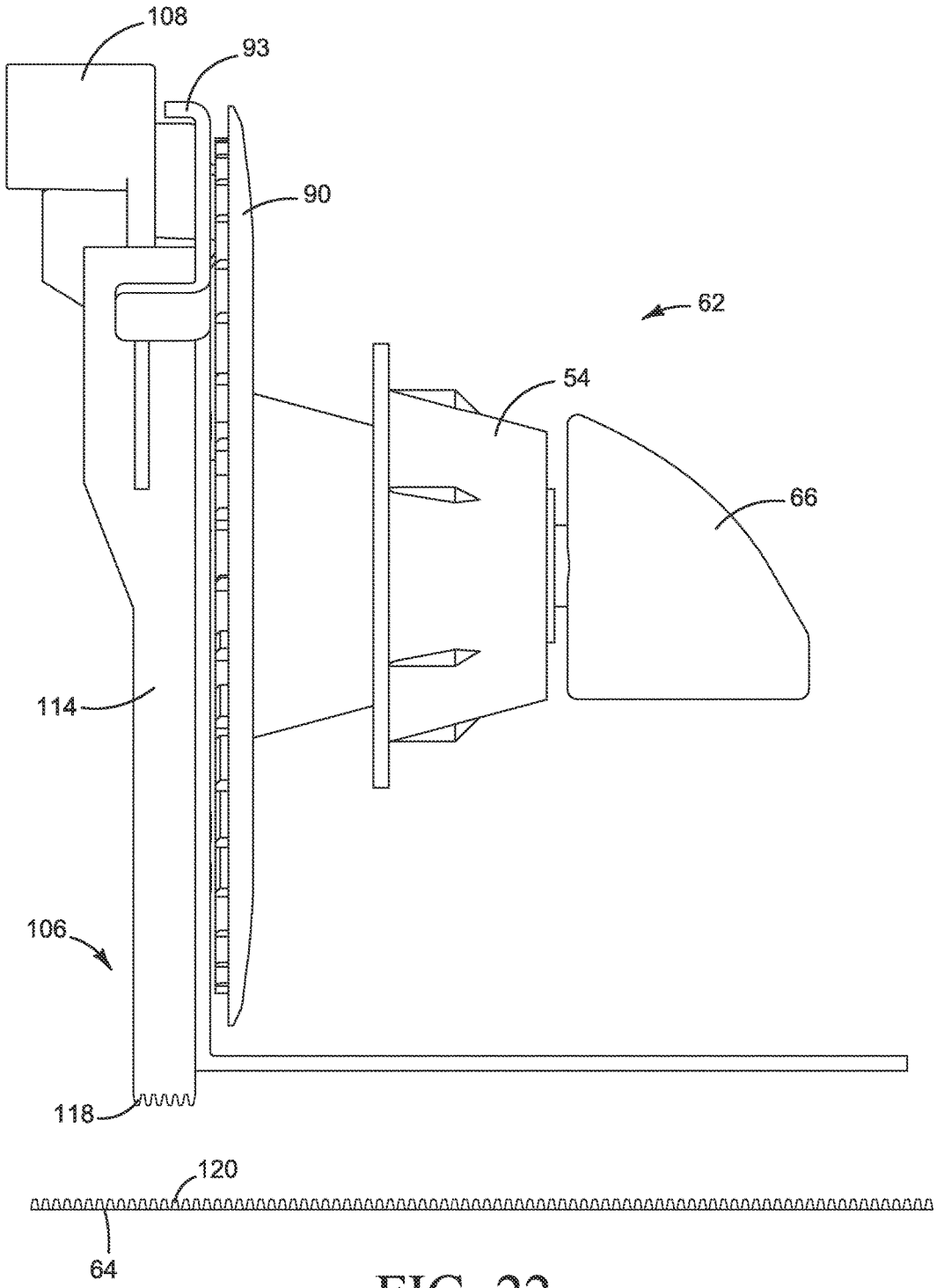

FIGS. 19 and 20 are rear elevation views of a car 58 that includes a brake 106 to keep car 58 parked for printing. While only car 58 is shown in FIGS. 19-25, a brake 106 is sometimes also used on the opposite end of the holder—car 60 for a holder 12 such as that shown in FIGS. 6 and 7. FIG. 19 shows brake 106 in an engaged position and FIG. 20 shows brake 106 in a disengaged position. FIGS. 21 and 22 are side elevation views of brake 106 corresponding to the positions shown in FIGS. 19 and 20, respectively. Referring to FIGS. 19-22, in the example shown, brake 106 is mounted to car back plate 93 and actuated by a handle 108. Brake handle 108 carries a pinion 110 connected to a rack 112 on brake arm 114. Rotating handle 108 counter-clockwise as indicated by arrow 116 in FIG. 20 raises brake arm 114 to disengage track 64, releasing the brake, as best seen by comparing FIGS. 19 and 20 and FIGS. 21 and 22. Rotating handle 108 back, clockwise, lowers brake arm 114 to engage track 64, setting the brake. In this example, teeth 118 on the end of brake arm 114 engage and disengage teeth 120 on track 64.

Figure 23:
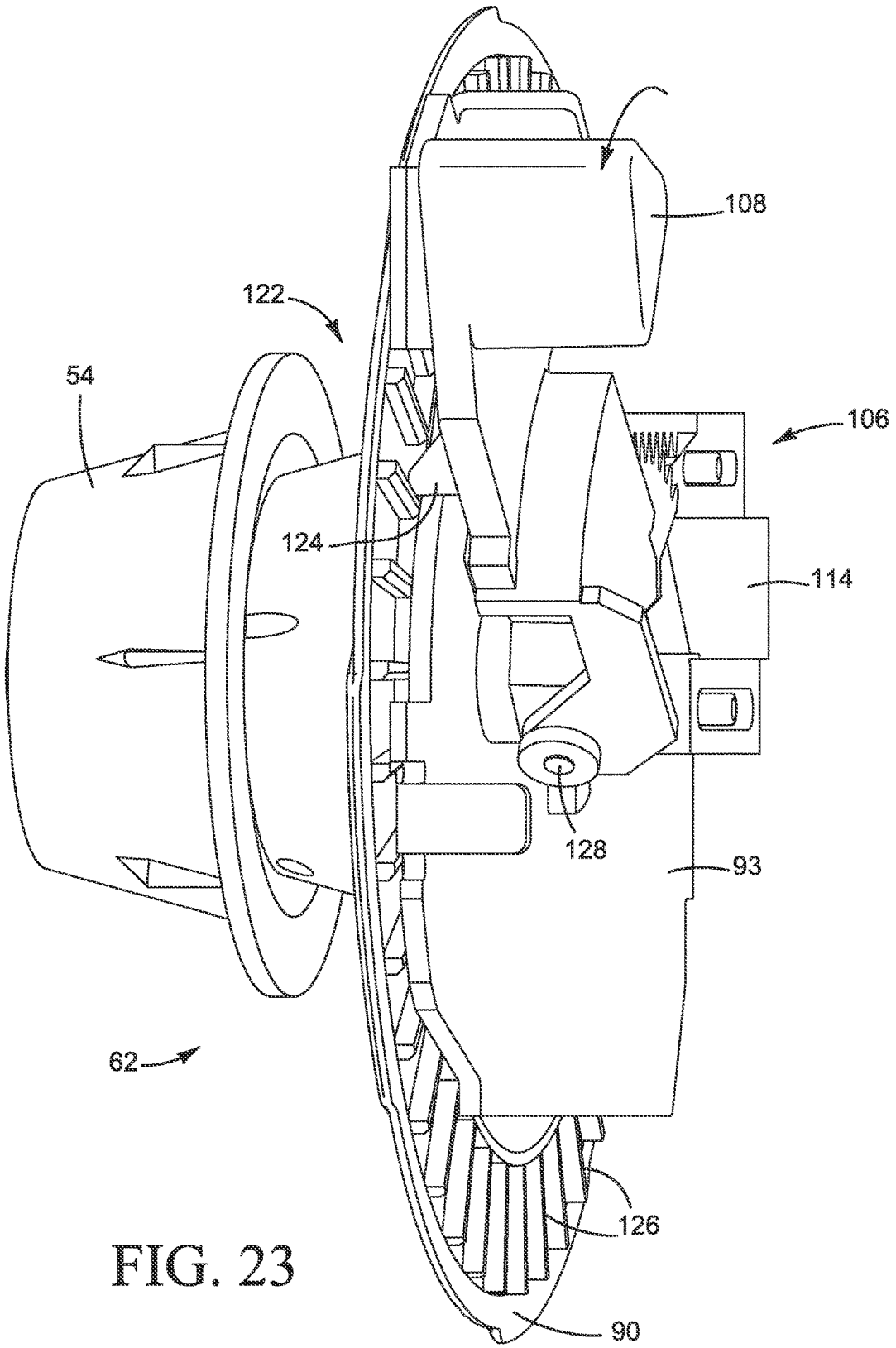
Figure 24:
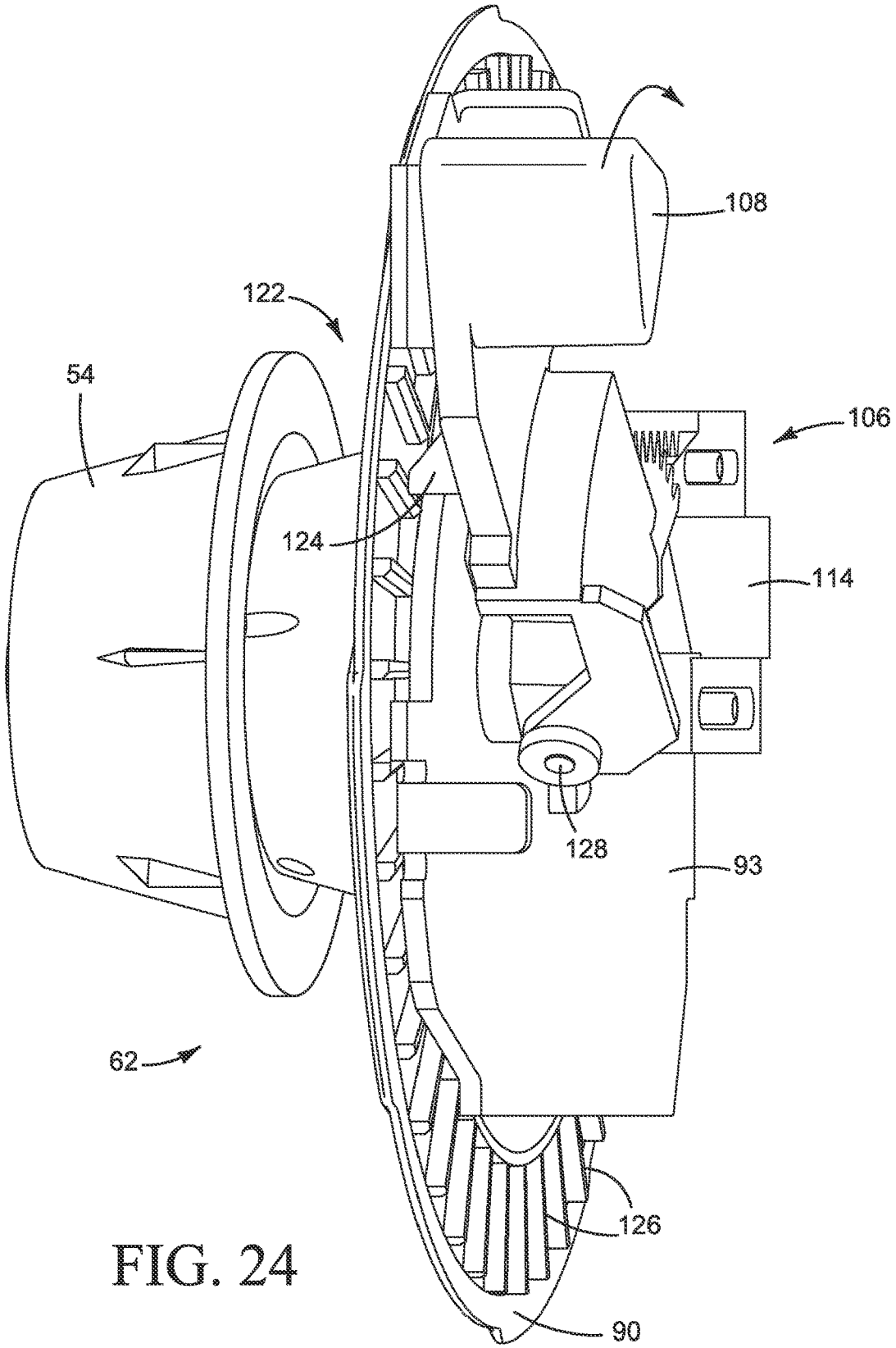
Figure 25:
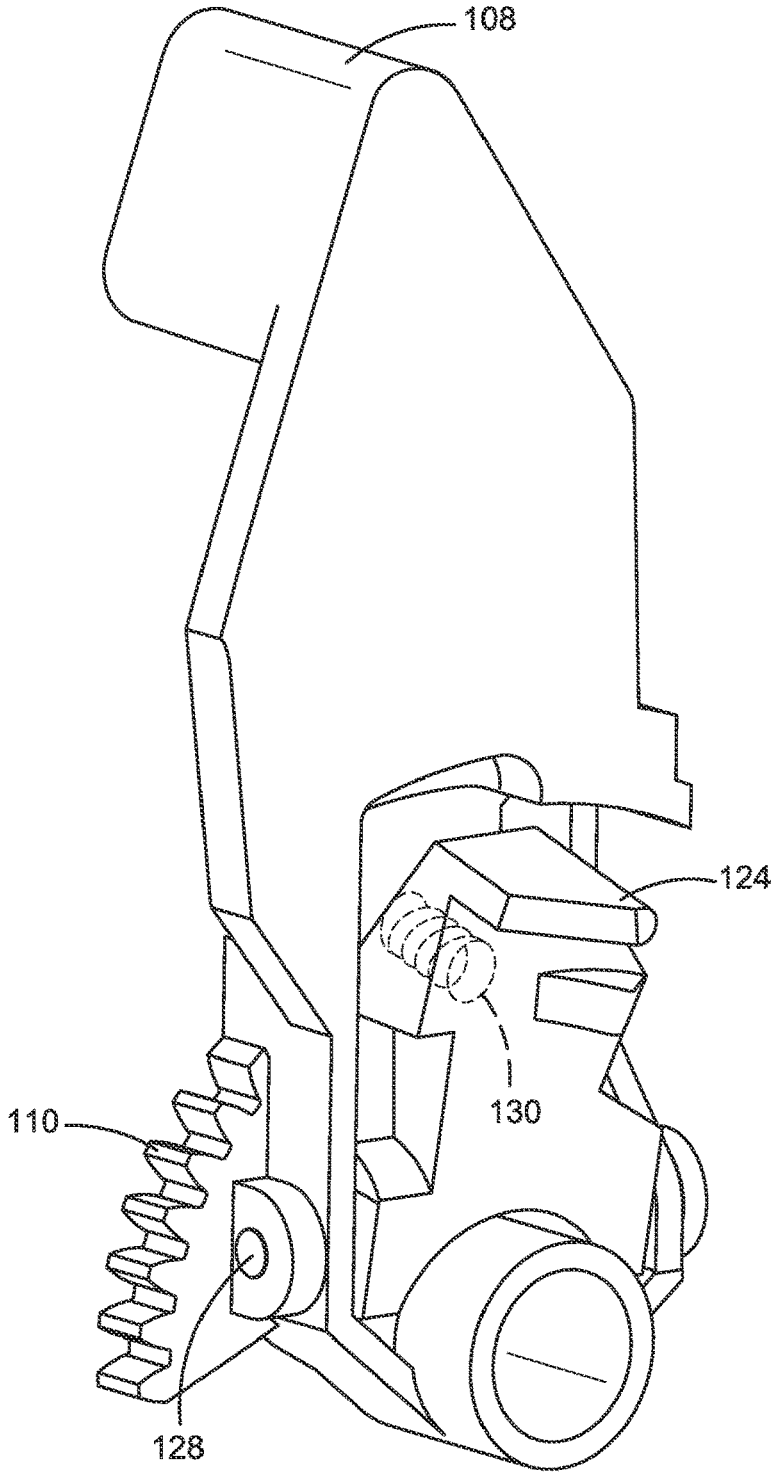

FIGS. 23 and 24 are perspectives looking down on hub assembly 62 and brake 106 moving towards a disengaged position (FIG. 23) and towards an engaged position (FIG. 24). Referring now also to FIGS. 23 and 24, in the example shown, shifter 50 includes a ratchet of other suitable link 122 that links brake 106 to shifter wheel 90. For a ratchet 122 shown in the figures, a pawl 124 attached to brake handle 108 engages a mating ratchet gear 126 on wheel 90. As best seen in the close-up of FIG. 25, pawl 124 pivots with respect to brake handle 108 on pins 128. A biasing spring 130 compressed between pawl 124 and handle 108 biases pawl 124 against ratchet gear 126. In operation, when brake handle 108 is rotated to disengage the brake, pawl 124 engages gear 126 as shown in FIG. 23 to rotate wheel 90 and move spacer 52, as described above. When brake handle 108 is rotated back to set the brake, wheel 90 remains stationary as pawl 124 "ratchets" back over gear 126 as shown in FIG. 24.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A hub assembly to hold one end of a media roll, the hub assembly comprising:

a hub to hold the media roll, the hub rotatable on an axis;

a spacer operatively connected to the hub to vary a distance along the axis between the hub and a support supporting the hub; and an actuator to move the spacer along the axis to vary the distance between the hub and the support, wherein varying the distance between the hub and the support causes a variation in a distance between the support and the media roll held on the hub.

2. The hub assembly of claim 1, wherein the actuator is to move the spacer along the axis toward and away from the support to vary the distance between the hub and the support.

3. The hub assembly of claim 2, wherein the actuator includes:

a rotatable wheel that is stationary along the axis; and a converter between the wheel and the spacer to convert rotary motion of the wheel into linear motion of the spacer.

4. The hub assembly of claim 3, wherein the converter includes:

a groove in the spacer not parallel to the axis; and a pin rotatable with the wheel and extending into the groove to move the spacer linearly with rotation of the wheel.

5. The hub assembly of claim 4, wherein the groove extends continuously around the spacer alternatively toward and away from the support to move the spacer back and forth away from and toward the support, respectively.

6. The hub assembly of claim 1, further comprising:

a car slideable along a track, the hub mounted on the car.

7. The hub assembly of claim 6, wherein the car is slideable along the axis.

8. A holder for a media roll, the holder comprising:

a first hub to support a first end of the media roll;

a second hub to support a second end of the media roll;

a first support that supports the first hub;

a second support that supports the second hub; and a shifter to change a first distance between the first support and the first hub, wherein changing the first distance between the first support and the first hub causes a change in distance between the first support and the first end of the media roll supported by the first hub.

9. The holder of claim 8, wherein the shifter is to change the first distance without changing a second distance between the second support and the second end of the media roll.

10. The holder of claim 8, wherein the shifter is to move the second support a second distance in response to changing the first distance.

11. The holder of claim 8, wherein the shifter comprises a spacer operatively connected to the first hub, and an actuator to move the spacer along an axis to vary the first distance between the first support and the first hub.

12. The holder of claim 8, further comprising:

a first car slideable along a track, the first hub mounted on the first car.

13. The holder of claim 12, further a second car slideable along the track, the second hub mounted on the second car.

14. A holder to hold a roll of print media along an axis in a printer with a stationary print bar, the holder comprising:

a first car carrying a first hub to mount a first end of the roll, the first car movable linearly along the axis and the first hub rotatable around the axis and movable linearly relative to the first car;

a second car carrying a second hub opposite the first hub to mount a second end of the roll, the second car movable linearly along the axis and the second hub rotatable around the axis and not movable linearly relative to the second car; and a shifter to shift a position of the roll with respect to the print bar by moving the first hub along the axis relative to the first car and changing a distance along the axis between the first and second cars.

15. The holder of claim 14, wherein the shifter comprises:

a spacer operatively connected to the first hub to define a first distance along the axis between the first hub and the first car, and an actuator to move the spacer along the axis to change the first distance; and a first link between the first car and the second car to automatically change a second distance along the axis between the first and second cars proportional to a change in the first distance.

16. The holder of claim 15, wherein the actuator includes a rotatable wheel that is stationary along the axis, and a converter between the wheel and the spacer to convert rotary motion of the wheel into linear motion of the spacer.

17. The holder of claim 16, comprising:

a brake to immobilize the first car, the brake movable between an engaged position in which the first car cannot move along the axis and a disengaged position in which the first car can move along the axis;

a handle to move the brake between the engaged and disengaged positions, and wherein the shifter includes a second link between the handle and the wheel to turn the wheel in response to the handle moving the from the engaged position to the disengaged position or from the disengaged position to the engaged position.

18. The holder of claim 17, wherein the second link includes a ratchet having a pawl connected to the handle and a gear connected to the wheel.

* * * * *